United States Patent [19]

Kaneko et al.

[11] 3,939,897

[45] Feb. 24, 1976

[54] METHOD FOR PRODUCING HEAT-INSULATING CASTING

[75] Inventors: Yasuhisa Kaneko; Yasuhiko Komatsu; Yoshihiro Hibino; Yasuo Okada, all of Toyota, Japan

[73] Assignee: Toyota Jidosha Kogyo Kabushiki Kaisha, Toyota, Japan

[22] Filed: July 10, 1973

[21] Appl. No.: 378,012

[30] Foreign Application Priority Data

Nov. 1, 1972 Japan ..... 47-109749

[52] U.S. Cl. ..... 164/103; 164/332

[51] Int. Cl.[2] ..... B22D 19/08

[58] Field of Search ..... 164/98, 103, 332; 138/143; 123/198 A

[56] References Cited

UNITED STATES PATENTS

| | | | |
|---|---|---|---|
| 2,745,437 | 5/1956 | Comstock | 164/332 X |
| 3,173,451 | 3/1965 | Slayter | 138/143 X |
| 3,568,723 | 3/1971 | Sowards | 164/98 X |
| 3,714,971 | 2/1973 | Venable | 138/143 |
| 3,718,172 | 2/1973 | Rice et al. | 164/98 X |

*Primary Examiner*—Francis S. Husar
*Assistant Examiner*—John E. Roethel
*Attorney, Agent, or Firm*—Stevens, Davis, Miller & Mosher

[57] ABSTRACT

A method for producing a heat-insulating casting characterized by placing a flexible ceramic semifinished product having a smooth surface, a modulus of elasticity of 200–5000 Kg/mm², a bending strength of 8–200 Kg/cm², and a wall-thickness less than ¼ of the inside diameter, inside a casting mold, and casting molten metal so as to enclose the ceramic semifinished product.

5 Claims, 3 Drawing Figures

METHOD FOR PRODUCING HEAT-INSULATING CASTING

BACKGROUND OF THE INVENTION

It has become a matter of serious public concern recently that one source of air pollution is the exhaust gas of automobiles, which contains a large amount of harmful unburned gas such as carbon monoxide and hydrocarbon.

It is known that, when these harmful gases are mixed with a proper quantity of secondary air before exhausting into the atmosphere, combustion again takes place and almost all the unburned gases are burned. Devices for such purposes have been developed which include a port liner, of which the exhaust port portion in the cylinder head is arranged to retain heat, an exhaust manifold of large capacity, a manifold reactor, and an afterburner.

These devices, however, have various disadvantages in that the adiabatic effect is small and performance insufficient for cleaning exhaust gas, their durability is inferior over an extended period of use at high temperatures, the devices are complicated, or their manufacture is not economical, i.e. low volume production and/or high cost, because the devices are made mainly of metallic material.

An attempt has been made to overcome these difficulties by using a ceramic material having a lower thermal conductivity than metallic material and which is more durable at high temperatures in combination with metallic material. In this device only the outer surface of a hollow ceramic core is made porous, and molten metal is poured to solidify on the outer side of the core to form a composite pipe of metal-ceramics.

In making this composite pipe attention must be paid to prevent either the metal or ceramic side from failing when solidifying or cooling; accordingly, only the outer surface of the ceramic is made porous, the ceramic is set as necessary and a casting mold is heated as a whole to pour molten metal so that the metal may be fully impregnated into the porous cavities on the ceramic surface.

As a result, the compressive force produced when the metal is solidified and cooled is released due to a yielding phenomenon occurring locally in the mechanical joint portion between the ceramic permeating into metal and the metal. The result is a composite structure having a ceramic side and a metal side at the juncture of which there is no apparent failure.

Nonetheless, the composite material formed according to this method is in a yielding state where minute cracks exist potentially in the mechanical joint portion of the ceramic and metal, although there exists no apparent crack. Consequently, when the composite is used in a system where it is subject to severe vibration, as in an automobile engine, or the like, cracking between the ceramic and metal develops rapidly. It is proved by experience that the durability of this construction to mechanical vibration is markedly inferior.

It is also known that ceramics which are porous only on the outer surface are produced by complicated processes and, as a result, it is difficult to manufacture complicated parts of exhaust systems of engines or relatively thin-walled parts.

SUMMARY OF THE INVENTION

The present invention relates to a method for producing a heat-insulating casting, comprising placing in a casting mold a flexible ceramic semifinished product having restricted physical properties and pouring molten metal to enclose the ceramic semi-finished product; the product is suited to internal combustion engines and exhaust gas purifying devices of internal combustion engines.

DESCRIPTION OF THE INVENTION

The present inventors invented and accomplished the following method as a result of ardent study for solving the problems found in the conventional heat-insulating casting.

Figure 1:
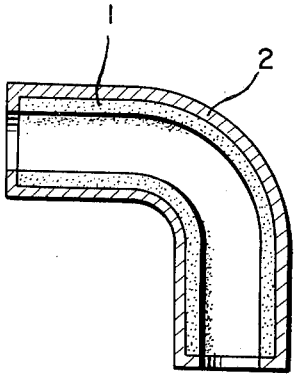
FIG. 1 shows a longitudinal cross-sectional view of a heat-insulating casting enclosing a heat-insulating casting member according to a method of the present invention.

The present invention comprises forming a ceramic pipe 1 having low modulus of elasticity, bending strength within the restricted range, and a smooth outer surface, setting the pipe in a predetermined casting mold, and pouring molten metal thereinto to solidify the metal thereon, thus forming a metallic layer 2 outside the ceramic 1 as shown in FIG. 1.

It is important in this case to first select an optimum range of the wall-thickness of the ceramic pipe in consideration of the modulus of elasticity and bending strength of the ceramic and the inside diameter of the ceramic pipe. Secondly, the outer surface of the ceramic pipe must be a smooth surface. There must not be cavities on the ceramic surface through which molten metal permeates.

When such ceramics are used as satisfying the above-mentioned two points, pipes will be obtained which are apparently sound and endurable without potential cracking between the ceramic part and the metal part, forming a double structure consisting of a metal part and the ceramic part.

The reason why a sound pipe of double structure is obtained by this method of the present invention will be explained as follows. The metal cast on the outer surface of the ceramic pipe naturally causes a contracting phenomenon when solidifying and cooling; at this time, a compressive force acts on the ceramic side and a tensile force acts on the metallic side simultaneously.

Since the conventional ceramics have a high modulus of elasticity, the deformation scarcely occurs in the range of force of elasticity; as the compressive force is also high, a high tensile force acts on the metallic side, thus frequently causing a breaking of metal.

In some cases when the wall-thickness of the ceramic part is small and the compressive force is relatively small, the ceramic side is compressed to breaking.

It is necessary for the present invention to lower the elastic modulus of the ceramics to select a proper range of bending strength, and to make the wall-thickness of ceramic pipes correspond to the elastic modulus, bending strength, and the contracting force of the cast metal occurring at the time of solidification and cooling. It is possible for the ceramic pipe to reduce its diameter within the elastic limit with the contracting phenomenon of the cast metal during solidification and contraction, so that the stress may be released and may not break while the metal side retains its sound state.

The boundary portion of the ceramic pipe and metal is not mechanically joined as by permeation of the metal into the ceramic interior; thus no potential cracking problem is created. The joint of the ceramic part and the metal in this case is formed by a sort of shrink fit due to contraction of the metal during solidification and cooling, and the compressive stress is accordingly in a balanced condition with tensile stress within the limit of elasticity. Because of this fact, the joint can withstand the mechanical vibration with sufficient durability. Against repeated heating and cooling by the gas passing through the interior, the compressive force acting on the ceramic part does not reduce to zero unless the metal fuses; accordingly, a sufficient interference is retained without possibility of failure.

The manufacturing method according to the present invention will be explained in successive order.

As one method for producing ceramics having low elastic modulus, an aggregate of refractory material, controlled in the largest grain size to be less than ¾ of the smallest wall-thickness is used. One hundred parts (by weight part hereinafter) of aggregate is compounded with 10 to 40 parts of alumina cement as a bonding agent, and 15 to 30 parts of water is added to 100 parts of that mixture and then agitated and mixed thoroughly to prepare a slip-like substance.

Refractory materials which are used include clayish chamotte, alumina, sillimanite, mullite, zircon, chromite, magnesia clinker, silicon carbide, fused corundum, fused silica, cynite, magnesia, chrome, fused spinel, silicon nitride, chrome-magnesia, magnesite-chrome, vermiculite, vermiculite asbestus, baryte, burned diatomaceous earth, pumice stone, etc.

In the next step, a proper core is provided for forming a hollow part in the casting mold having a predetermined shape, using wood, synthetic resin, plaster, etc. The aforesaid slip is then quickly poured into the mold. The casting mold or core in the case of ceramic pipes having complicated shapes is easily formed if materials like foamed polystyrene, etc. soluble in organic solvents, such as acetone, benzene, toluene, methyl ethyl ketone are used.

The pouring of the slip is improved if a moderate vibration is applied to the casting as a whole, thereby preventing the occurrence of large bubbles on the ceramic surface. Especially when the wall-thickness of the ceramics is thick, application of pressure to the slip is effective as an aid in pouring.

After pouring, the slip is left for 4 to 24 hours as it is in the mold for curing. After the desired strength is acquired, the slip is taken out and, at the same time, the core is taken out. Thereafter the slip is preliminarily dried at temperatures from 70° to 105°C; however, in this case care must be exercised not to elevate the temperature rapidly to prevent the possibility of causing cracks.

The high temperature heating is finally performed. Since the elastic modulus and bending strength vary depending on the temperature of this heating, proper heating conditions must be selected in consideration of the material quality and shape of the ceramics and the metal to be cast.

It is recommended that the ceramics be heated at least to the casting temperature of the metal to be poured for preventing casting defects, for instance, blow casting, in case of pouring the metal for enclosing the ceramics. However, if the temperature is raised too high, the refractory aggregate itself starts baking and changes the elastic modulus and mechanical strength, and the ceramics shrink to a great degree. Necessary precautions must therefore be taken. When high temperature strength is desired a phosphate bonding agent such as aluminum primary phosphate may be used. To set a ceramic pipe to a prescribed position of a casting mold, the portion for core print is necessary for both ends of the ceramic pipe; this may be provided integrally when the ceramic pipe is made, or may be made of molding sand of carbon dioxide process, shell mold process, oil sand process, etc.

Where the wall-thickness of ceramic pipes is thin and likely to fail due to the pressure of molten metal during the pouring operation, it is effective to fill the hollow portion of the ceramic pipe with molding sand as mentioned before. Finally, molten metal is poured in the casting mold to which the ceramic pipe is set.

There is no limitation to the quality of molten metal. Gray cast iron, nodular graphite cast iron, alloy cast iron, cast steel, alloy cast steel, aluminum alloy, copper alloy, magnesium alloy, zinc alloy, etc. are usually used.

In the manufacturing method of this invention, the bending strength, elastic modulus, and wall-thickness of the ceramics as well as the size of the pipe cross-section and the kind of metal cast to enclose the outside are important factors as described above. The typical experimental results conducted on the pipe having a shape illustrated in FIG. 1 are shown in Tables 1 and 2.

TABLE 1

* Ceramic pipe is enclosed with aluminum alloy

| Quality of Ceramics | Bending Strength Kg/cm² | Elastic modulus Kg/mm² | Wall thickness mm | Result |
|---|---|---|---|---|
| Siliceous | 80 | 3,500 | 12 | Small cracks occur on ceramics |
| Siliceous | 80 | 3,500 | 8 | No abnormality |
| Aluminous | 150 | 5,000 | 11 | Minute cracks occur on ceramics |
| Aluminous | 150 | 5,000 | 6 | No abnormality |
| " | 500 | 10,000 | 8 | Ceramics fail |
| " | 500 | 10,000 | 5 | Large cracks occur on ceramics |

TABLE 2

* Ceramic pipe is enclosed with gray cast iron

| Quality of Ceramics | Bending strength Kg/cm² | Elastic modulus Kg/mm² | Wall thickness mm | Result |
|---|---|---|---|---|
| Siliceous | 100 | 4,000 | 15 | Small cracks occur on ceramics |
| Siliceous | 100 | 4,000 | 10 | No abnormality |
| Aluminous | 150 | 5,000 | 12 | Small cracks occur on ceramics |
| " | 150 | 5,000 | 8 | No abnormality |
| " | 700 | 15,000 | 10 | Both metal and ceramics fail |
| " | 700 | 15,000 | 5 | Ceramics fail |

In the experiments shown in Tables 1 and 2, the inside diameter of the ceramic pipes is 40 mm; the wall-thickness of the metal side is 6 mm in the case of aluminum alloy and 4.5 mm in the case of gray cast iron.

Overall estimation of the results on Tables 1 and 2 reveals that the following conditions are necessary for ceramics in order to obtain sound pipes of double-structure.

1. Modulus of elasticity is to be in a range from 200 to 5,000 Kg/mm$^2$.

If the elastic modulus is lower than 200 Kg/mm$^2$, the ceramic pipe deflects too much and the product is of questionable practical durability although the product is apparently sound. In excess of 5,000 Kg/mm$^2$, sufficient deflection is not obtained and the ceramic pipe tends to crack and sound products are not obtainable.

2. The wall-thickness is to be less than ¼ of the inside diameter at that part.

If the wall-thickness exceeds the above-mentioned limit, deformation is difficult even though the elastic modulus is low and sound products are not obtainable.

If the cross-section of a pipe is rectangular, the diagonal length shall be taken into consideration.

3. The bending strength is to be in the range from 8 to 200 Kg/cm$^2$.

A bending strength less than the above limit presents a durability problem, and if it exceeds the upper limit, sound products are not obtainable even though the elastic modulus and wall-thickness dimensions are within acceptable limits.

The bending strength is limited within the above-mentioned range in order to impart flexibility to the ceramic pipes.

4. The outer surface of the ceramic in contact with metal must be smooth and not be so porous as to be permeated by metal.

The homogeneity of the elastic modulus, bending strength, porosity, and other mechanical properties must be retained all through the product. In the event that the strength is locally unsatisfactory, the stress will concentrate at that point and the balance of forces is lost, causing the ceramic pipe to fail.

The product obtained according to the present invention accelerates re-combustion as the ceramic portion is much less heat conductive than the metal and has excellent adiabatic characteristics so as to effectively retain the heat of the gas passing through the interior.

The ceramic material also has a large heat capacity. Accordingly, even when the running condition of the engine varies and the gas temperature falls as a consequence, the wall portion retains its high temperature and can maintain repeated combustion. Because of this, the harmful unburned gas in the exhaust gases can be burned. Seen from the viewpoint of endurability, the product according to the present invention has a low elastic modulus and therefore readily absorbs mechanical vibrations; on the other hand, the boundary portion between the ceramic and the metallic part consists of a type of shrink fit as a result of the balance of compressive force and tensile force; this makes possible the use of the device in vigorously vibrating environments, like engines. From a thermal point of view, it does not present any difficulty since ceramics are superior to metal.

Depending upon the quality, some ceramic materials are unstable at high temperatures above 1,000°C. It is useful for these materials, when used in practice, to coat the inner surface of the ceramics with a heat-resisting material or to impregnate them with a heat-resisting binder, for instance, colloidal silica, ethyl silicate, aluminum primary phosphate, etc. These processes may be applied before or after pouring the metal for enclosing the ceramics, as convenient.

The double-structure pipe according to the present invention may be used as the port liner of an exhaust port extending from the combustion chamber to the head outlet, a manifold of large capacity, the outer case of a manifold reactor, or the outer case of an after-burner.

The products according to this invention may also be applied not only to gasoline engines of 4- or 2-cycles but also to all internal combustion engines including rotary engines, diesel engines, etc. Besides purification of exhaust gas, the products of this invention may be satisfactorily applied for the purpose of heat retention of gas.

Practical examples will be cited to explain concretely the manufacturing method of the present invention.

Example 1

Figure 2:
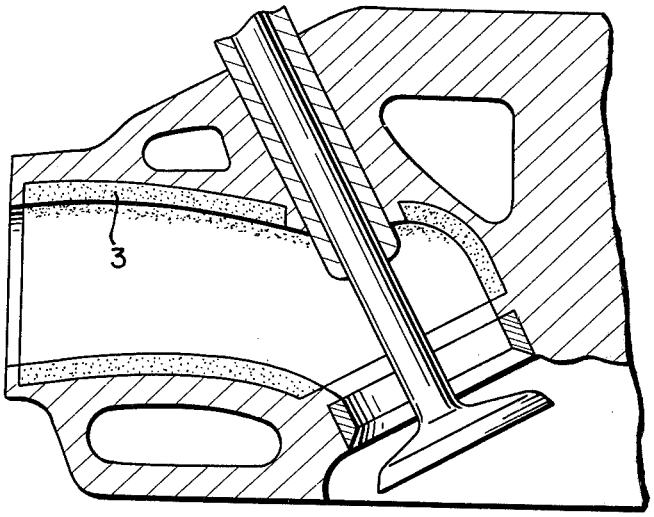
FIG. 2 shows a cross-sectional view of a cylinder head manufactured by the method of the present invention.

An example will be described which was used as a port liner of a cylinder head of a 1600 cc 4-cylinder gasoline engine. The cross-sectional view of the cylinder head is shown in FIG. 2. The port liner made of ceramics has a wall-thickness of 4 mm, a total length along the central line of 90 mm, and a rectangular cross-section of 27 × 32 mm.

The material used for the ceramics was prepared by adding 20 parts (part by weight hereinafter) of alumina cement to 75 parts of fused silica aggregate, the largest grain size of which is 2.5 mm, subsequently adding 22 parts of water to 100 parts of the mixture, and then agitating the whole to a slip-like state.

To a mold made of resin fabricated in conformity to the outer contour of a port liner, a core of foamed polystyrene fabricated in conformity to the inner contour of the port liner was set. Then, while applying vibration to the mold as a whole, the slip was poured thereinto. The slip was then left for about 16 hours as it was poured; afterward it was taken out of the mold and the core was dissolved out by acetone. Subsequently, the molding was gradually dried for 24 hours at temperatures of 70° to 200°C and then dried at high temperatures for 24 hours elevating the temperature to 850°C.

The thus obtained ceramics exhibit a bending strength of 100 Kg/cm$^2$, an elastic modulus of 950 Kg/mm$^2$, a bulk specific gravity of 1.60 and a dimensional variation of −0.5%.

This molding was set to a prescribed wooden pattern and the part for the core print was formed integrally with a casting core using the carbon dioxide process. This casting core was set to a metal mold for casting the cylinder head and aluminum alloy was cast at 750°C in a low pressure casting process. The composition of the aluminum alloy is 3.5% copper, 9.5% silicon, 0.5% magnesium, and the rest of aluminum. After casting, the core sand was removed and heat-treated (JIS-J5 treatment) at 200°C for 3 hours for improving the strength of aluminum alloy.

The cylinder head equipped with a ceramic port liner manufactured in the above manner was mounted on an engine, and the composition and temperature of exhaust gas examined. The result of the examination revealed that carbon monoxide and hydrocarbon decreased by about 50% as compared with the conventional liners, and that the temperature was raised about 150°C at the neighborhood of the port liner outlet. To study the durability of the liner, a 100-hour durability test was conducted at 6,000 rpm under full load. No abnormality was observed.

Example 2

A further example is described which was used for a port liner of a cylinder head of a 2,000 cc, 4-cylinder gasoline engine.

The ceramic part has a thickness of 4.5 mm, a length of 110 mm along the central line, and a rectangular cross-section of 32 × 40 mm. The ceramic material was prepared by adding 20 parts of alumina cement to 80 parts of aluminous aggregate, the largest grain size of which was 3.0 mm, adding 20 parts of water to 100 parts of the mixture, and then kneading to a slip-like state.

The succeeding processes up to the process of taking the ceramics out of the mold were conducted in the same manner as in Example 1. Drying was effected by first heating up to 200°C, further heating up to 1,400°C, thereafter taking 48 hours.

The thus obtained ceramics exhibit a bending strength of 450 Kg/cm², an elastic modulus of 1,500 Kg/mm², a bulk specific gravity of 2.80, and a dimensional variation of −0.65%.

The molding was set to a heated metallic mold and shell mold sand was blown in, forming a shell mold core for casting so as to integrally include the part for the core print. This core was set to a green sand mold for casting a cylinder head, and gray cast iron was cast into it at 1,380°C. The composition of the gray cast iron was 3.3% carbon, 2.0% silicon, 0.7% manganese, the rest being iron.

The cylinder head equipped with the ceramic port liner manufactured in the above manner was mounted on an engine, and the composition of exhaust gas investigated. The result of this investigation shows that carbon monoxide and hydrocarbon were reduced by about 40% as compared with the conventional liners. The durability of the liner was also tested, repeating up-and-down test 100,000 times in which the revolutions per minute was raised rapidly from 1,000 to 6,000 per minute and then immediately slowed down to 1,000 per minute. No abnormality was observed in this test.

Example 3

Example 3 was performed by adding 15 parts of aluminum primary phosphate to 100 parts of alumina aggregate used as the ceramic material in Example 2 and using the thus obtained slip-like substance.

The processes up to the removal of ceramics from the mold were performed in the same manner as in Example 1. Drying was effected by first heating up to 200°C, further heating to a high temperature of 1,200°C taking 48 hours. The thus obtained ceramics exhibit a bending strength of 190 Kg/cm², an elastic modulus of 4,800 Kg/mm², a bulk specific gravity of 2.75, and a dimensional variation of −0.63%.

In the succeeding steps, a ceramic port liner was manufactured in the same manner as in Example 2. As a result of testing by mounting a cylinder head, the same results as in Example 2 were obtained in performance and durability.

Example 4

This example was used for an exhasut manifold of large capacity for a 2,000 cc, 4-cylinder gasoline engine.

Figure 3:
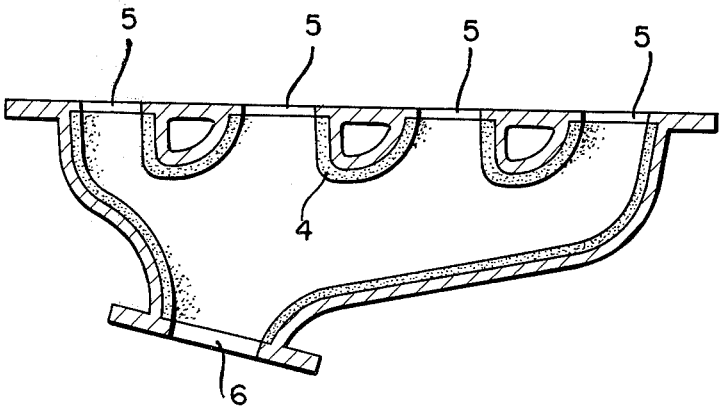
FIG. 3 shows a cross-sectional view of a manifold of large capacity manufactured by the method of the present invention.

FIG. 3 shows the cross-sectional view of the manifold; the ceramic multiple pipe 4 is 6 mm thick, the inside diameter of an inlet 5 of exhaust gas is 35 mm, and the inside diameter of an outlet 6 is 42 mm.

The ceramic material was prepared by adding 20 parts of alumina cement to 80 parts of aluminous aggregate, the largest grain size of which was 4 mm, and adding 20 parts of water to 100 parts of the mixture to form a slip-like substance. The slip-like substance was poured into prepared molds in the same manner as in Example 1 to form the ceramic multiple pipe 4 and thereafter heated to a high temperature of 1,550°C. The obtained ceramics exhibited a bending strength of 180 Kg/cm², an elastic modulus of 4800 Kg/mm², a bulk specific gravity of 2.85 and a dimensional variation of −0.70%. This was formed integrally as a core for casting in the carbon dioxide process and set to a mold for casting manifolds; nodular graphite cast iron was poured at 1,350°C. The composition of the nodular graphite cast iron was 3.8% carbon, 2.7% silicon, 0.5% manganese, 0.04% magnesium, the balance being iron. The manufactured manifold of large capacity was mounted on an engine for testing. The result shows that carbon monoxide decreased by 60% and hydrocarbons by 35%, respectively, as compared with the conventional manifolds. A durability test was conducted by actually running 50,000 Km at high speed. No abnormality was observed.

We claim:

1. A method for manufacturing heat-insulating castings comprising the steps of: setting a flexible semifinished ceramic product, having a smooth surface, an elastic modulus of 200 to 5,000 kg/mm², a bending strength of 8 to 200 kg/cm², and a wall-thickness less than ¼ of its inside diameter, inside a casting mold and casting molten metal to enclose the ceramic semifinished product.

2. A method for manufacturing heat-insulating castings according to claim 1, comprising the further steps of: preparing a slip-like substance of ceramic material; pouring said ceramic material into a shaping mold; curing said ceramic material in said shaping mold; removing said ceramic material from said shaping mold; and drying said material under heated conditions to produce said semi-finished ceramic product.

3. The method according to claim 2 wherein said ceramic material is cured in said shaping mold for a period of between approximately 4 and 24 hours and said drying step includes heating said material for a preset time at a temperature of between approximately 70° and 200°C.

4. The method according to claim 3, wherein said drying step includes heating said material at said temperature of between approximately 70° and 200°C for approximately 24 hours and thereafter further heating said material for a period of between approximately 24 and 48 hours at a temperature of between approximately 850° and 1,550°C.

5. The method according to claim 4, wherein in said further heating step said ceramic material is heated to at least the casting temperature of said molten metal prior to casting said metal in said casting mold.

* * * * *